US007704004B2

(12) United States Patent
Fisher

(10) Patent No.: US 7,704,004 B2
(45) Date of Patent: Apr. 27, 2010

(54) APPLICATOR

(76) Inventor: Martin Fisher, 26 Greenlands, Midway, Swadlincote, Derbyshire (GB) DE11 0XS ( * ) Notice: Subject to any disclaimer, the term of this patent is extended or adjusted under 35 U.S.C. 154(b) by 1051 days.

(21) Appl. No.: 10/516,388

(22) PCT Filed: May 27, 2003

(86) PCT No.: PCT/GB03/02304

§ 371 (c)(1),
(2), (4) Date: Aug. 4, 2005

(87) PCT Pub. No.: WO03/101623

PCT Pub. Date: Dec. 11, 2003

(65) Prior Publication Data

US 2006/0233596 A1 Oct. 19, 2006

(30) Foreign Application Priority Data

May 31, 2002 (GB) ..... 0212614.2

(51) Int. Cl.
*B43M 11/02* (2006.01)

(52) U.S. Cl. ..... 401/220; 401/119; 401/176; 401/179

(58) Field of Classification Search ..... 401/208, 401/218, 219, 220, 171, 176, 177, 179, 181, 401/182, 137
See application file for complete search history.

(56) References Cited

U.S. PATENT DOCUMENTS

| | | | | | |
|---|---|---|---|---|---|
| 2,488,655 | A | * | 11/1949 | Bennett | 401/15 |
| 3,231,151 | A | * | 1/1966 | Clark et al. | 222/391 |
| 4,566,816 | A | * | 1/1986 | Janssen | 401/219 |
| 4,667,363 | A | * | 5/1987 | Calvert | 15/248.2 |
| 5,857,795 | A | * | 1/1999 | Liou | 401/218 |

* cited by examiner

*Primary Examiner*—David J Walczak
(74) *Attorney, Agent, or Firm*—Schwartz Law Firm, P.C.

(57) ABSTRACT

An applicator in which paint flow is facilitated utilizing a grip pump bias to a paint distributor such as a roller. The roller is configured within a head such that paint is appropriately distributed with limited leakage in order to allow easy operation for distributing paint upon a surface. The application is arranged to operate at elevated or displaced positions and allow greater paint flow control.

50 Claims, 12 Drawing Sheets

APPLICATOR

The present invention relates to applicators and particularly but not exclusively an applicator for applying paint to a surface.

Tools suitable for applying paint to a surface are well known and include brushes, rollers, paint pads etc. Normally, these require the separate provision of a paint container with the paint loaded from the container onto the tool. Loading is by dipping an end of the tool into the container and wiping off the excess. More recently pressurised paint containers have been used to supply paint to the tool. Both approaches suffer a number of disadvantages. They can be cumbersome to use. Pressured paint containers or pumping requires the container to be remote from the tool as it would make the tool too heavy to handle. Thus, flexible piping must be used and this impedes the movement of the operator. Achieving a controllable flow of paint to the tool may be problematic since the viscosity of paint may vary considerably. The extensive clean down of equipment after painting is finished can be off putting to users, and may often mean that such systems are only used by professionals or by users painting large surface areas. The pressure in such systems can vary resulting in a variable flow of paint to the tool.

Examples of previous devices utilised with respect to paint and similar fluids are outlined below.

CH 480198 (TECHNOVALOR) relates to a paint distribution device in which an air overpressure is provided in order to propel the paint towards a roller. The overpressure pushes the paint towards the roller but not conveniently in order to allow remote application or provide sufficient flow rate, particularly with respect to viscous paints.

DE 29606843 (HOFMANN HEINZ) discloses use of a disposable carton incorporating a nozzle for distribution of paint upon a roller. However, it is difficult to provide an even distribution of paint upon the roller without wastage and mess as consideration is not given with respect to control of the biasing means for even distribution of paint.

EP 0224472 (POWER FLO PRODUCTS) relates to provision of a fountain applicator. Essentially a syringe pump is provided in order to fill a hollow tube by displacement of a piston, and then by reverse displacement of the piston, that paint is driven towards a roller. Such an approach limits the degree of extension that can be provided and has particular difficulties with respect to viscous paints.

U.S. Pat. No. 2,898,618 (ALLEN WHITFIELD) relates to provision of a paint applicator in which an industrial compressor is utilised in order to drive the paint towards a roller. An applicator head is provided in order to achieve even distribution of paint upon the roller, but provision of a compressed air supply renders such applicators inappropriate for domestic use and still leads to paint loss and spillage as a result of inappropriate control of paint distribution upon the roller.

WO 02/28457 (LIEN WILEY) relates to a health and beauty fluid applicator in which the fluid is driven towards a roller head suspended in a slot cradle. Thus the head moves to allow variation in the gap between the roller and an opening for release of fluid and therefore distribution upon a pad. With regard to paint variations in the outlet gap between the roller and the opening will result in inappropriate control of the paint and loss/spillage.

In view of the above it will be appreciated that previously applicators were not particularly acceptable for domestic use and continued loading of the roller manually without the potential for paint spillage and loss. In such circumstances simple open tray loading of rollers has continued to be the normal approach with regard to domestic use of paint roller applicators.

According to the present invention, there is provided an applicator for applying paint to a surface, the applicator including a body for paint, paint distribution means to distribute paint in use onto a surface by contact with that surface, the body including paint biasing means to bias, in use, the paint toward the distribution means, an operator in use holding the tool by the body and operating control means for control of the bias means and so the flow of paint distribution means, the applicator characterised in that the paint biasing means acts by applying incremental axial displacement of the paint.

Preferably the paint distribution means is releasably engageable with the body and forms a separable applicator head. The paint distribution means may include a brush, a pad, or a roller. The head may include mounting means for rotatably mounting a roller with a roller surface which in use contacts the surface to be painted. The head may include a hood which partially encloses the roller.

Possibly, the head includes flow regulation means to regulate the flow of paint to the roller surface in association with the bias means. The flow regulation means may include a gap defined between a distribution means surface and the hood. Preferably the head includes at least one passage defined in the hood and normally a plurality of passages therein. Preferably the passages are arranged in a row running parallel with the axis of the distribution means surface. Preferably the row of passages extends substantially the width of the surface. Alternatively the row is shorter in length than the width of the surface, and each end of the row is not less than 25 mm from the corresponding end of the surface. Preferably the gap is at a minimum at or adjacent to the or each passage. Normally, the distribution means surface is a roller surface.

Preferably the hood includes a concave internal hood surface. Normally, the hood will have a different radius to the roller surface. Typically, the hood will be of larger radius than the surface. Possibly the roller surface and the hood surface are not concentric. Advantageously, the roller surface and hood surface will diverge away from each other about the passages.

The head may include a recess defined in the hood, and the or each passage may lead to the recess. Possibly, the recess forms a plenum chamber. Preferably, the recess extends substantially the width of the distribution means surface. Advantageously, each end of the recess is not less than 18 mm from the corresponding end of the distribution means surface. Edges may be defined where the recess meets the internal hood surface, and the gap may be at a minimum at the edges. The distribution means surface may contact the edges. Elongate projections may be provided along the edges parallel to the roll axis of the roller, and the projections may be rounded in form.

Preferably the mounting means for the roller are adjustable, so that the minimum gap is adjustable. The mounting means preferably allows the roller to be removed from the head.

Possibly, a paint trap is provided adjacent to the roller.

Possibly, there is a stop member to limit the bias means for more smooth control of the flow of paint.

Possibly, the bias means is associated with an extension handle to allow displaced or elevated operation of the applicator.

The distribution means surface may include textures or patterns to facilitate paint distribution on the surface to be painted.

In one embodiment, the body may include holding means for a paint container.

Possibly the paint container is removable. Possibly, the paint container is elongate with an oval or rectangular cross-section with the major axis substantially coincidental with a slot of the applicator.

In another embodiment, the body includes refilling means. The refilling means may comprise a threaded end cap.

Preferably the paint biasing means includes a plunger, which may be movable to act on the paint in the body or the paint container such that as the plunger advances, the bias on the paint forces flow to the paint distribution means.

Preferably the plunger includes rod means, which extends away substantially along the longitudinal axis of the body from a plunger head acting upon the paint. Preferably, the body includes gripping means having a handle in the form of a tube having a passage therethrough. Preferably the extends beyond the handle and may include a gripping portion at its distal end by which the plunger may be moved. The gripping portion may include a lateral extension, extending laterally beyond the handle. The lateral extension may form a base on which the tool may be supported, and may include a planar surface perpendicular to the longitudinal axis of the body.

The rod means may comprise a rod extending from the plunger head and a gripping member telescopically mounted within the handle and slidably engaged with the rod. The gripping portion may be mounted on the gripping member. Preferably the gripping member is biased to a retracted position.

Preferably the control means includes a trigger mounted on or adjacent to the handle. The handle may include a linkage operable by the trigger to advance the plunger. The linkage may comprise a link plate having an oversized aperture through which the rod passes. The link plate may be biased towards the trigger and, in a relaxed condition, out of engagement with the plunger, so that as the trigger is operated the link plate is brought into engagement with the plunger, further operation of the trigger moving the link plate towards the paint in the body or container and causing the plunger to advance to bias the paint towards the distribution means.

Preferably the applicator includes connection means interposed between the applicator head and the body. The connection means may be articulated to allow the angle of the paint distribution means to be varied relative to the longitudinal axis of the body.

Preferably the paint container is formed of translucent or transparent material, or may include a window of translucent or transparent material, to provide a visual indication of the amount of paint in the container.

According to the present invention, there is provided a method of applying paint to a surface, the method comprising the use of an applicator as claimed in any preceding claim, the method comprising providing paint to the applicator, holding the body, providing bias to the paint to drive that paint towards the distribution means and operating the control means to control a flow of paint to the paint distribution means, while moving the tool so that the paint distribution means contact and move across a surface to be painted.

Preferably, the paint is provided by installation of pre-filled cartridges. Alternatively the method includes providing the paint by filling the body or paint container by unscrewing the end cap, pouring in paint, and replacing the end cap.

In a further alternative method, the body or container may be filled by providing paint in flexible pre-filled sachets or bags, the bags sized to fit in the container, the bags being placed in the open container, punctured, and the end cap being replaced. Typically, the puncturing will be just prior to installation or during provision of the bias applied to the paint towards the paint distribution means.

Alternatively in accordance with the present invention, there is provided pouring apparatus for a paint can, the apparatus including a pouring member having an engaging means engageable in use with a portion of the rim of a paint can, the pouring member including a concave pouring surface, the pouring member arranged so that when in engagement with a paint can it has an upright position and the pouring surface directs any paint on the surface to run onto the surface of the paint in the can at a displaced position from the side of the can.

Preferably the pouring surface extends upwardly in use to an apex. Preferably the engaging means encloses a portion of the rim of the can.

Preferably the pouring member and engaging means are formed integrally, and may be of a resilient flexible material.

Still further according to the present invention, there is provided a method of filling a paint container, the method including filling the paint holding the body, providing bias to the paint to drive that paint towards the distribution means and operating the control means to control a flow of paint to the paint distribution means, while moving the tool so that the paint distribution means contact and move across a surface to be painted, the method characterised in that the bias is provided by applying incremental axial displacement of the paint towards the distribution means.

Preferably, the paint is provided by installation of pre-filled cartridges. Alternatively the method includes providing the paint by filling the body or paint container by unscrewing the end cap, pouring in paint, and replacing the end cap.

In a further alternative method, the body or container may be filled by providing paint in flexible pre-filled sachets or bags, the bags sized to fit in the container, the bags being placed in the open container, punctured; and the end cap being replaced. Typically, the puncturing will be just prior to installation or during provision of the bias applied to the paint towards the paint distribution means.

Alternatively in accordance with the present invention, there is provided pouring apparatus for a paint can, the apparatus including a pouring member having an engaging means engageable in use with a portion of the rim of a paint can, the pouring member including a concave pouring surface, the pouring member arranged so that when in engagement with a paint can it has an upright position and the pouring surface directs any paint on the surface to run onto the surface of the paint in the can at a displaced position from the side of the can.

Preferably the pouring surface extends upwardly in use to an apex. Preferably the engaging means encloses a portion of the rim of the can.

Preferably the pouring member and engaging means are formed integrally, and may be of a resilient flexible material.

Still further according to the present invention, there is provided a method of filling a paint container, the method including filling the paint Additionally, in accordance with the present invention there is provided an applicator for applying paint to a surface, the applicator including paint distribution means within which an effective slot outlet is provided through which paint is presented to paint distribution means through use of paint biasing means, the paint being accommodated within a paint canister, characterised in that the paint canister has a cross-section of elongate dimensions such that the major axis of the canister is substantially aligned with the slot for better paint distribution through that slot by the paint biasing means.

Further in accordance with the present invention there is a paint distribution insert for applicators of paint, the insert comprising a groove network of varying cross-section and arranged whereby resistance to paint flow through the insert is varied across that insert for more even paint distribution across an outlet from an inlet position of substantially narrower width.

Also, in accordance with the present invention there is provided an applicator for applying paint to a surface wherein that paint is distributed by a roller and the roller is secured through a cam whereby the roller rotates with a rollover rotation past a paint outlet characterised in that the rollover rotation is eccentric with differing gap widths between a roller surface and the outlet on one side and on the other side in the roller rotation direction.

Typically, a slot is provided within which a pin is secured to provide for eccentric rotation as well as varying width between the respective sides of the outlet.

Embodiments of the present invention will now be described, by way of example only with reference to the accompanying drawings in which:—

Figure 7A:
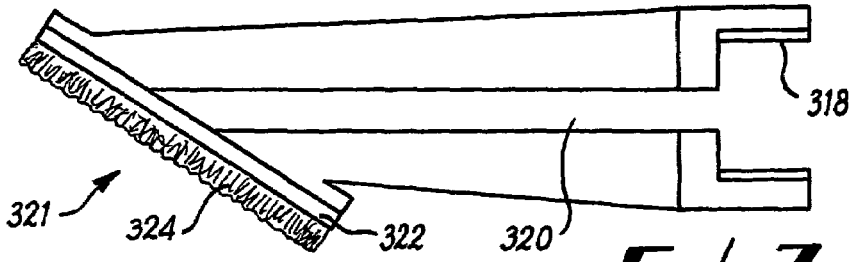
Figure 7B:
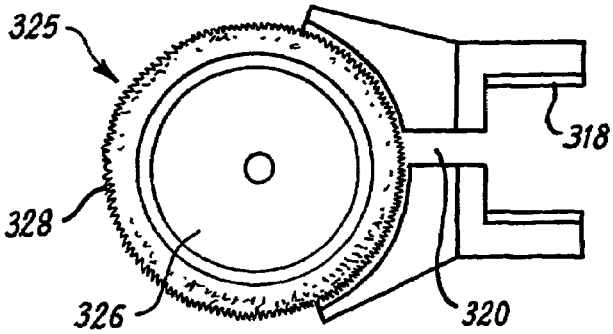
Figure 9:
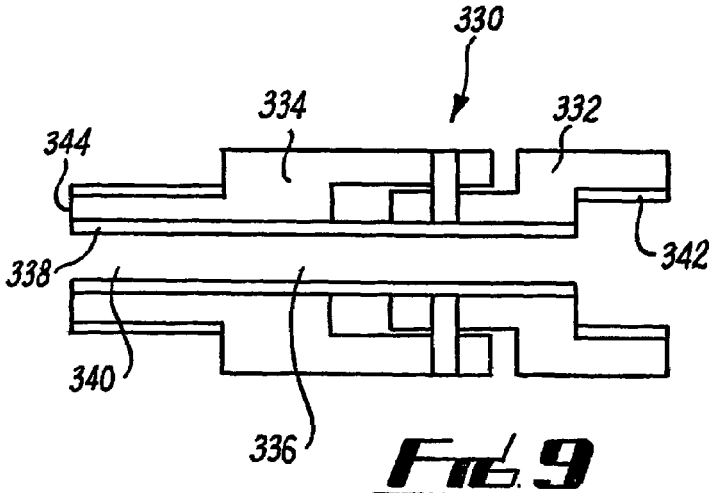
Figure 8:
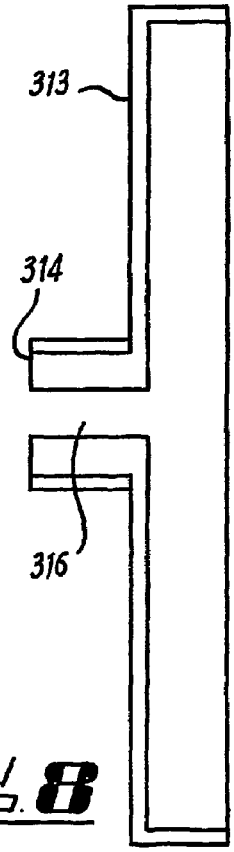
Figure 10:
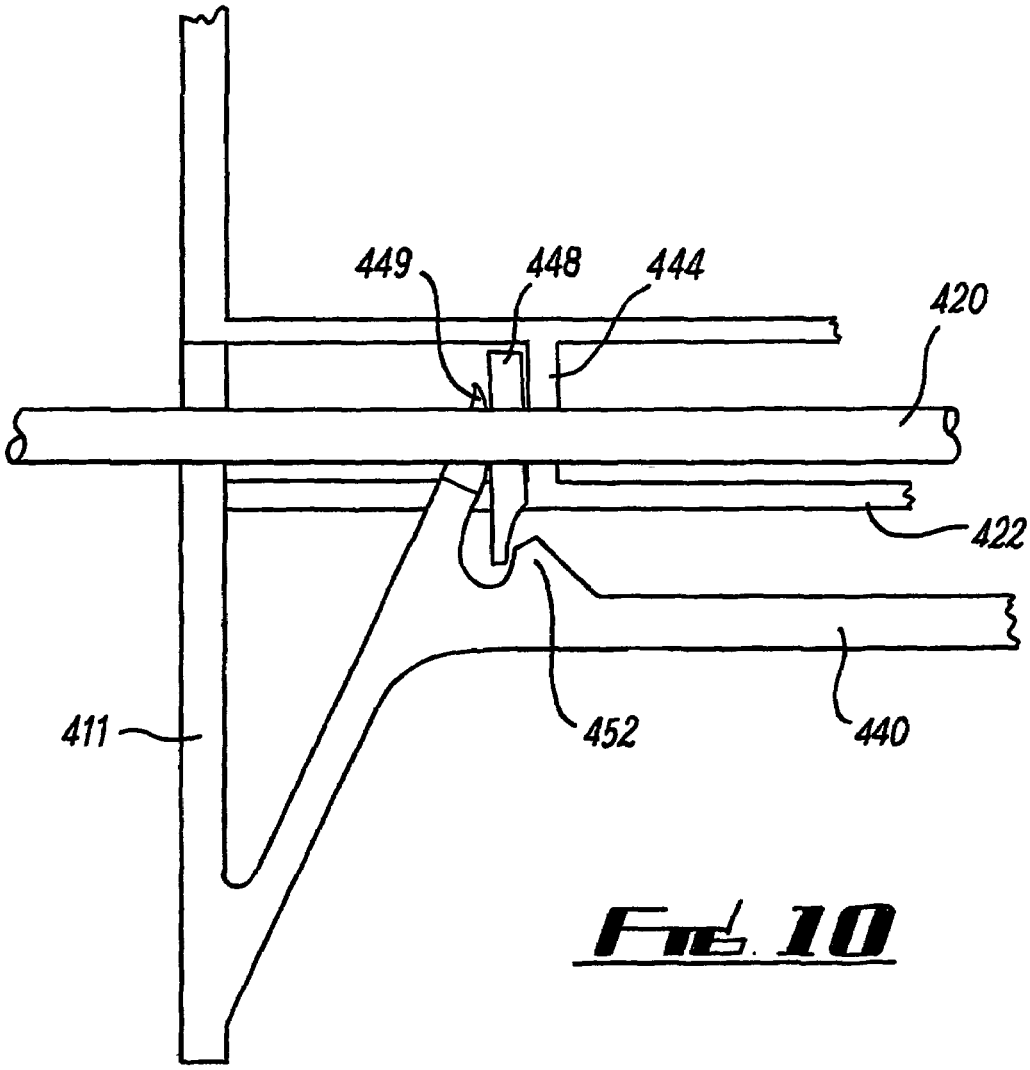
Figure 12:
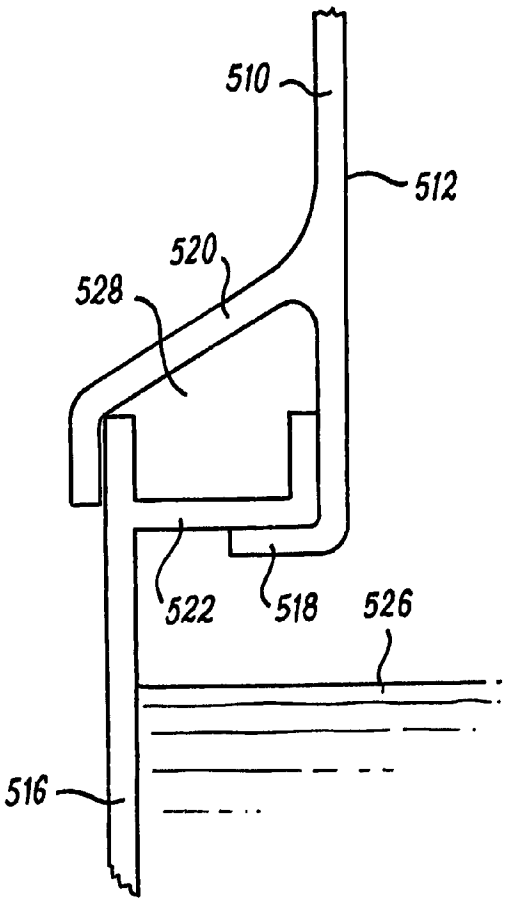
Figure 11:
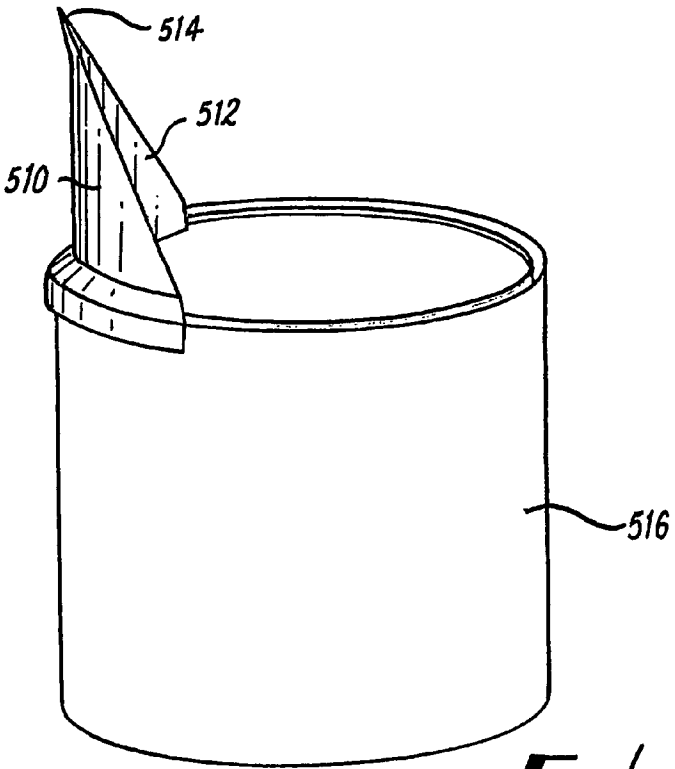
Figure 13:
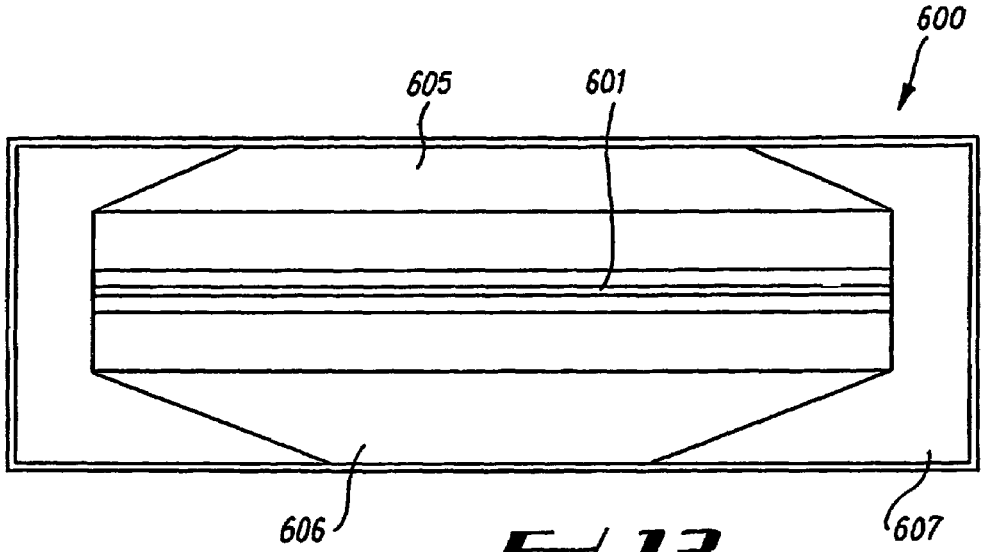
Figure 14:
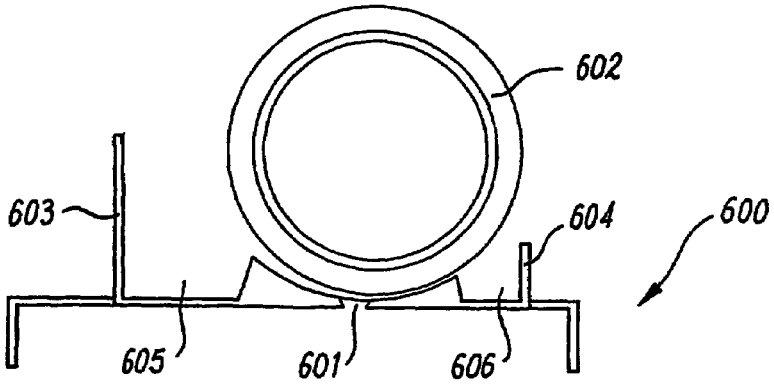
Figure 15:
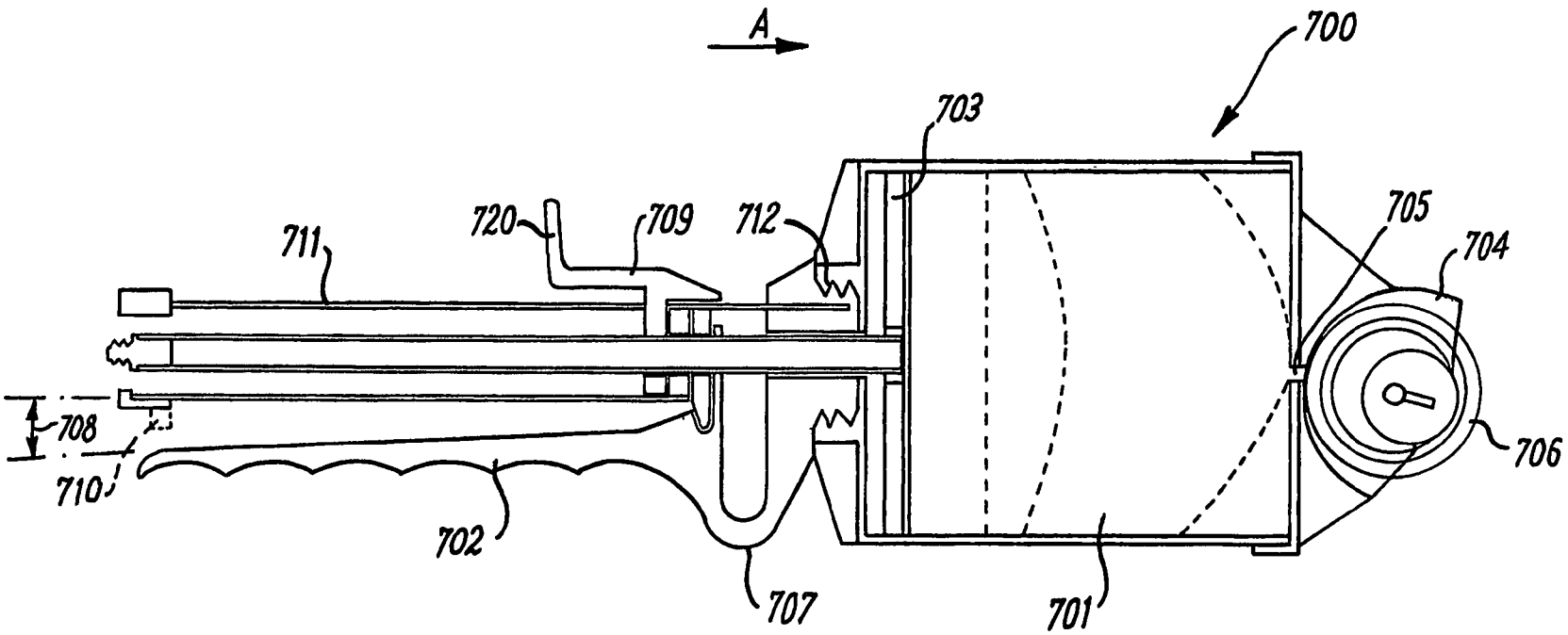
Figure 16:
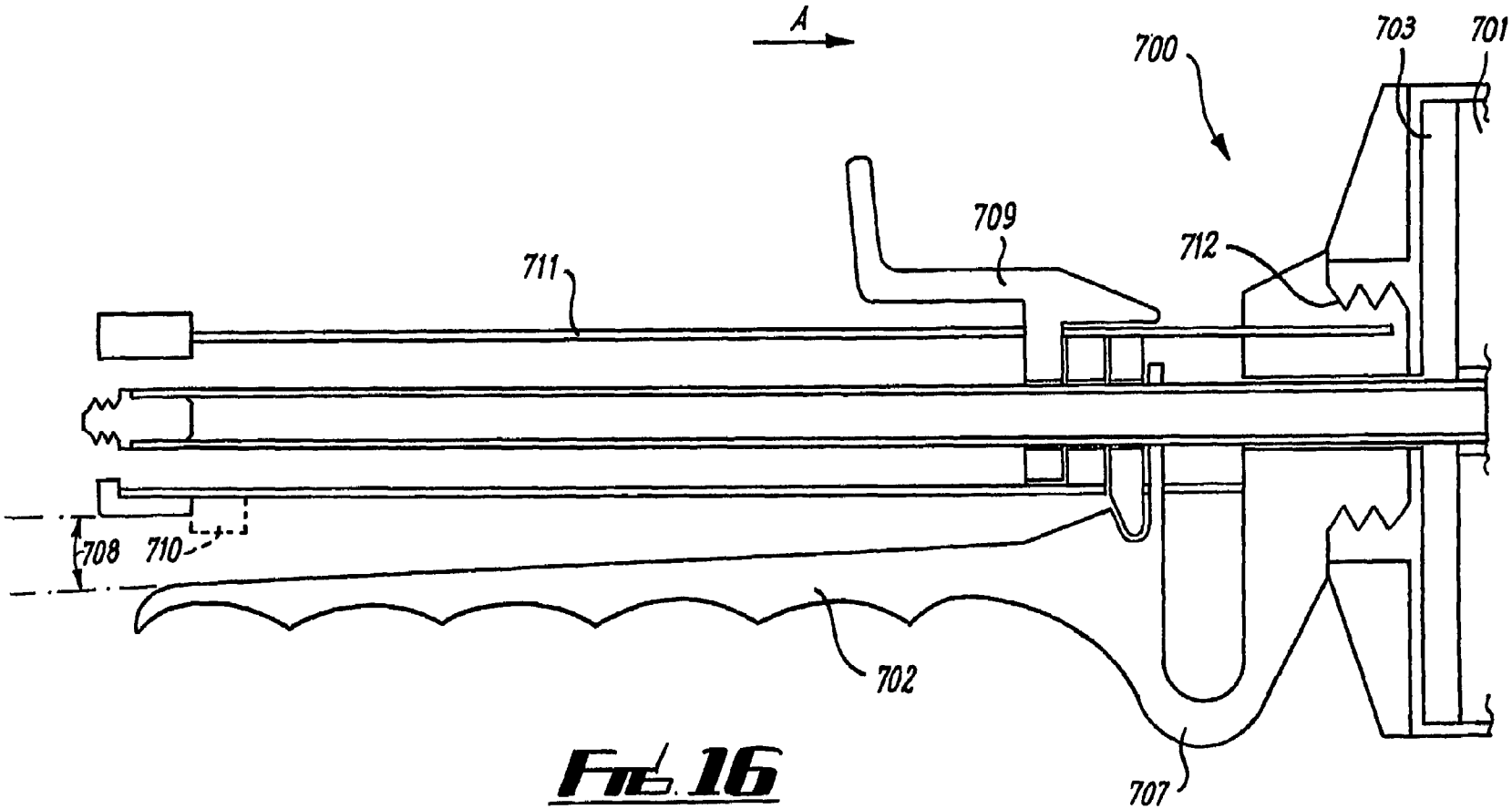
Figure 17:
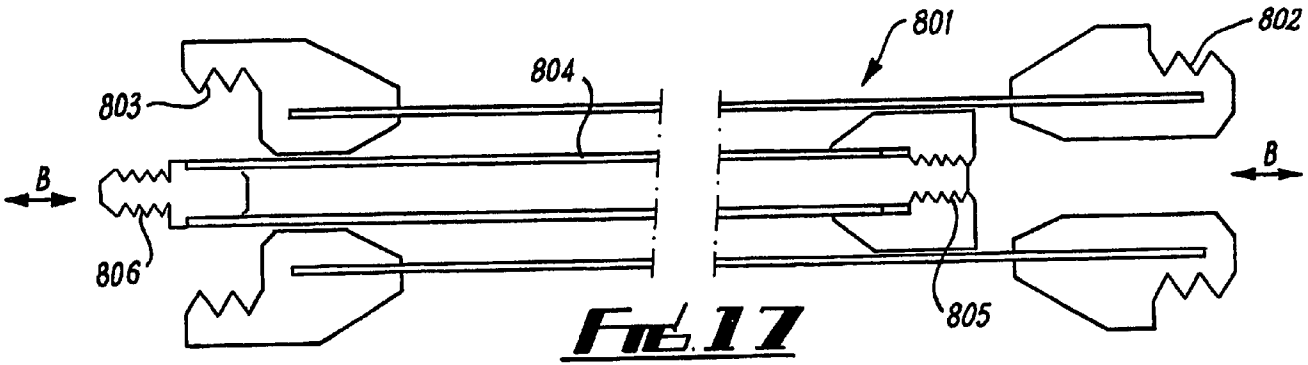
Figure 18A:
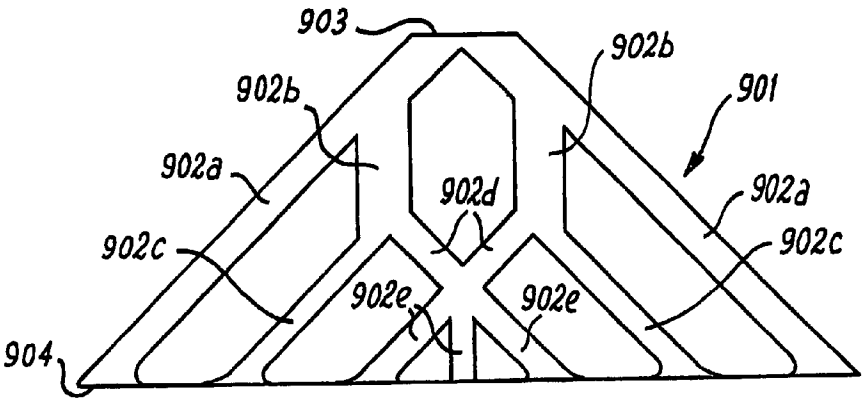
Figure 18B:
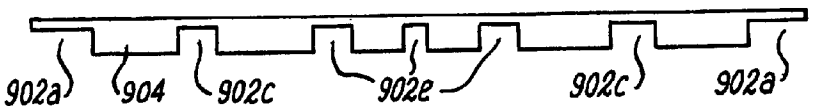
Figure 19:
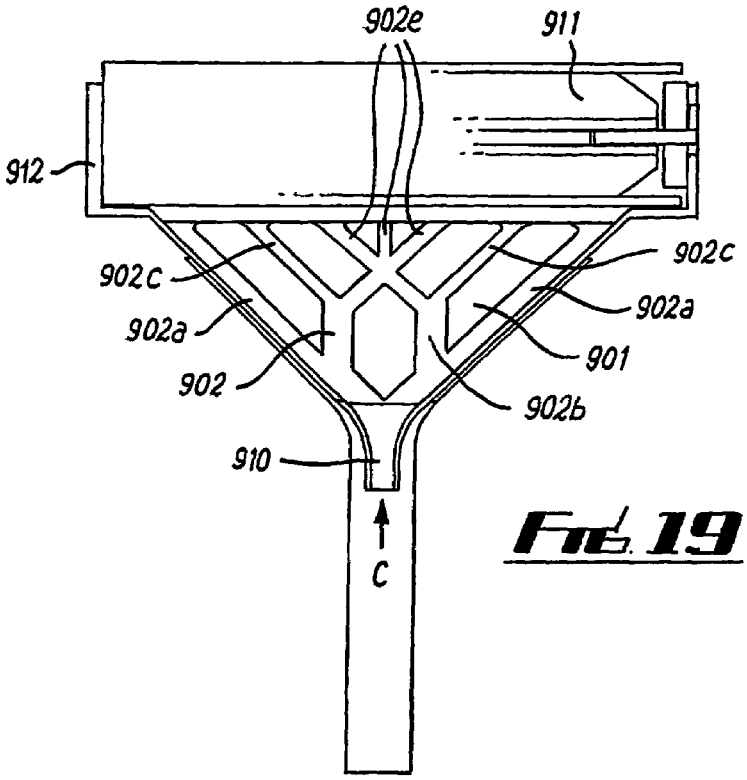
Figure 20:
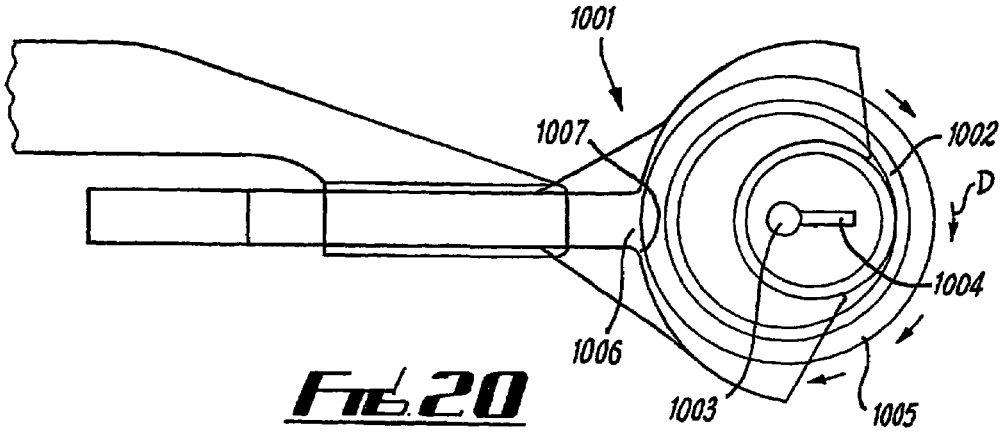

FIGS. 7*a* and 7*b* are diagrammatic sectional views of alternative paint distribution means;

FIG. 8 is a diagrammatic section view of an alternative end cap;

FIG. 9 is a diagrammatic section view of a connection means;

FIG. 10 is a section view of a detail of an alternative trigger arrangement;

FIG. 11 is a perspective view of pouring apparatus according to the invention in use on a paint can;

FIG. 12 is a section view detail of an engaging means of the pouring apparatus in engagement with a rim of a paint can;

FIG. 13 is a bottom view of an applicator head including traps in accordance with the present invention;

FIG. 14 is a side cross-section illustrating the adaptor head depicting FIG. 13 with a roller associated therewith;

FIG. 15 is a side cross-section of an adaptor in accordance with the present invention modified to provide better pump bias control and to allow use of an extension handle in accordance with the present invention;

FIG. 16 is a cross-section of the grip pump assembly as depicted in FIG. 15;

FIG. 17 is a longitudinal cross-section of an extension handle in accordance with the present invention;

FIGS. 18*a* and 18*b* provide a plan and end view of a distribution insert for use within applicators;

FIG. 19 is a part plan cross-section depicting use of an insert as depicted in FIG. 18 within an applicator; and, FIG. 20 is a side view illustrating a cam adjustment of an applicator arrangement in accordance with a further embodiment to the present invention.

Figure 1:
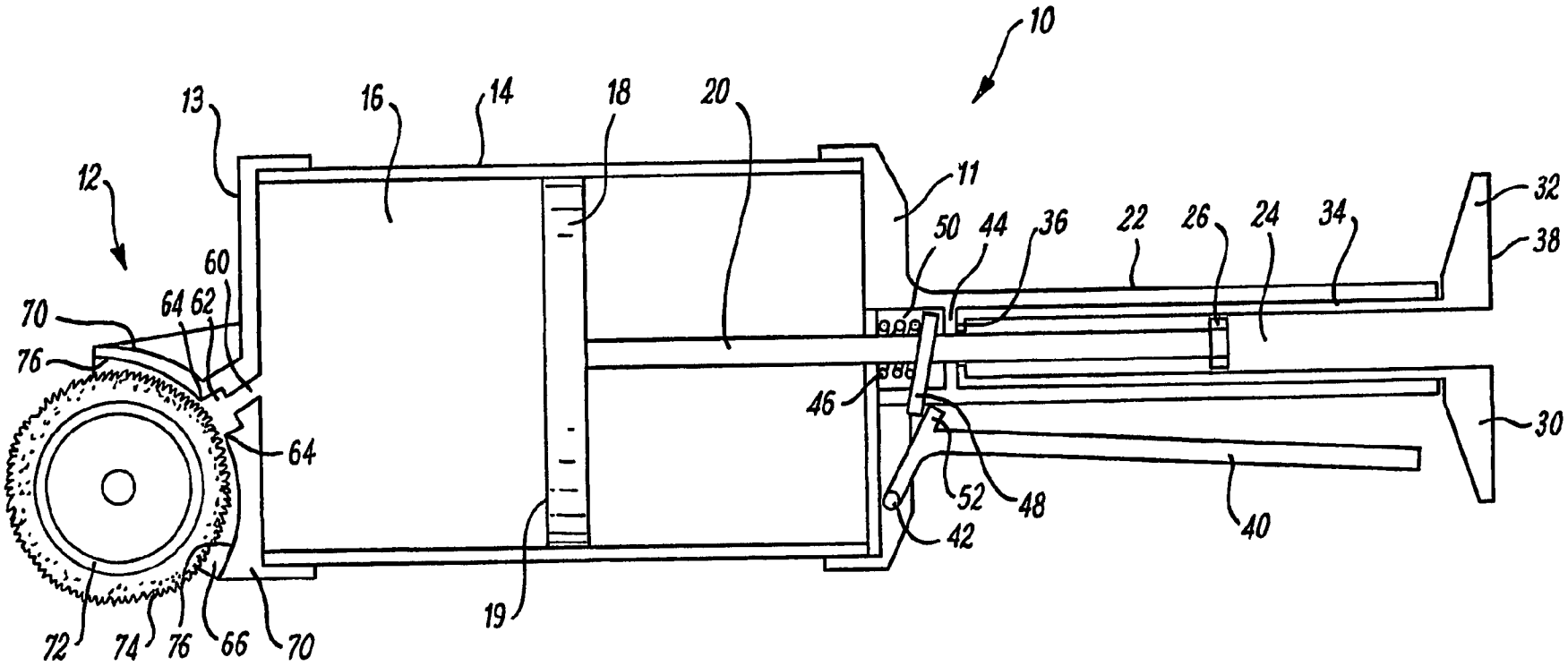
FIG. 1 is a diagrammatic cross-sectional view of an applicator according to the invention.

FIG. 1 shows a side view of an embodiment of the present invention. An applicator includes a body 10 in engagement with an applicator head 12. The body 10 includes a cylindrical wall 14. One end of the cylindrical wall 14 is closed by an end cap 11. The end cap 11 extends outwardly to allow the body to be gripped. The body 10 includes a handle tube 22 having a passage 24 therethrough. The head 12 includes a head end cap 13 in threaded engagement with the other end of the cylindrical wall 14. The body 10 includes paint biasing means in the form of a plunger 18 having a head 19 and a rod 20 operated by a trigger 40 pivotally mounted on end cap 11 by pivot 42. The plunger head 19 is movable within the cylindrical wall 14 and the rod 20 extends substantially along the longitudinal axis of the body 10, through the handle end cap 11 and into the handle passage 24. The space within the cylindrical wall 14 between the plunger head 19 and the end cap 13 defines a paint containing compartment 16.

The rod 20 includes a stop means in the form of a nut 26 at its distal end. A gripping member 34 is slidably mounted on the rod 20 within the passage 24, the gripping member 34 being in the form of a tube having a partially closed end 36, the partially closed end 36 defining an aperture through which the rod 20 is removable. The nut 26 is located on the distal side of the closed end 36 and is larger in diameter than the aperture in the end 36. The gripping member 34 is telescopically mounted within the handle passage 24. The gripping member extends outwardly beyond the handle 22 to form a gripping portion 30 including a lateral extension 32 which extends laterally beyond the handle 22. The lateral extension 32 has a planar surface 38 perpendicular to the longitudinal axis, forming a base on which the tool may stand upright.

The paint biasing means includes control means including the aforesaid trigger 40, and a linkage operable by the trigger 40 to advance the plunger 18. The linkage is in the form of a link plate 48 defining an oversized aperture through which the plunger rod 20 passes. The link plate 48 is located in a compartment of the handle 22 defined by the handle passage 24, a passage wall 44 and the handle end cap 11. A compression spring 46 biases the link plate 48 out of engagement with the plunger rod 20 and against a projection 52 extending from the trigger 40.

The head 12 includes paint distribution means in the form of a roller 72 having a roller surface 74. The head 12 includes a hood 70 extending from the end cap 13. Conduits are provided from the paint containing compartment 16 to the roller surface 74 in the form of a plurality of passages 60. As seen on the left of FIG. 3, the passages 60 are arranged in a row running parallel with the roller axis. Typically, the row is narrower than the width of the roller surface 74 with the ends being not less than 25 mm from the corresponding end of the roller surface. Thus, the passages 60 adequately distribute paint to the roller 72.

Figure 2:
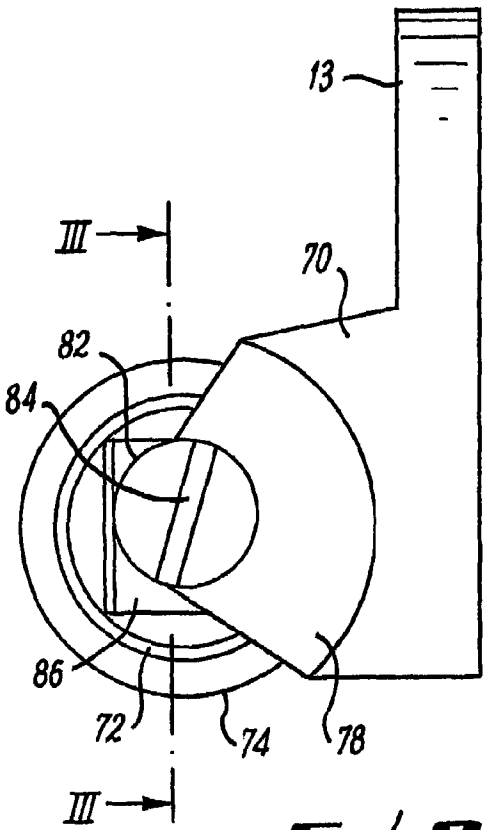
FIG. 2 is a side view of a head of the applicator depicted in FIG. 1.

As shown in FIG. 2, the head 12 includes a hood 70 and includes side plates 78 rotatably mounting the roller 72. The hood 70 has a concave internal surface 76 of larger radius than the roller surface 74. The surfaces 74 and 76 are not concentric, and flow regulation means are provided in the form of a gap 66 defined between the concave internal surface 76 of the hood and the roller surface 74 about the passages 60. Regulation is provided by the narrowness of the gap 66 in relation to the viscosity of the pint and roller displacement under compression in contact with the surface to be painted.

The passages 60 open into a recess 62 defined in the internal surface 76 of the hood 70. Again as seen on the left of FIG. 3, the recess 62 is narrower than the width of the roller surface 74 with each end being not less than 18 mm from the corresponding end of the roller surface 74. Edges 64 are defined where the recess 62 meets the hood internal surface 76, and the roller 72 is mounted such that the gap 66 is at a minimum at the recess edges 64 for regulation of the rate and/or volume of paint presented to the roller 72.

Figure 3:
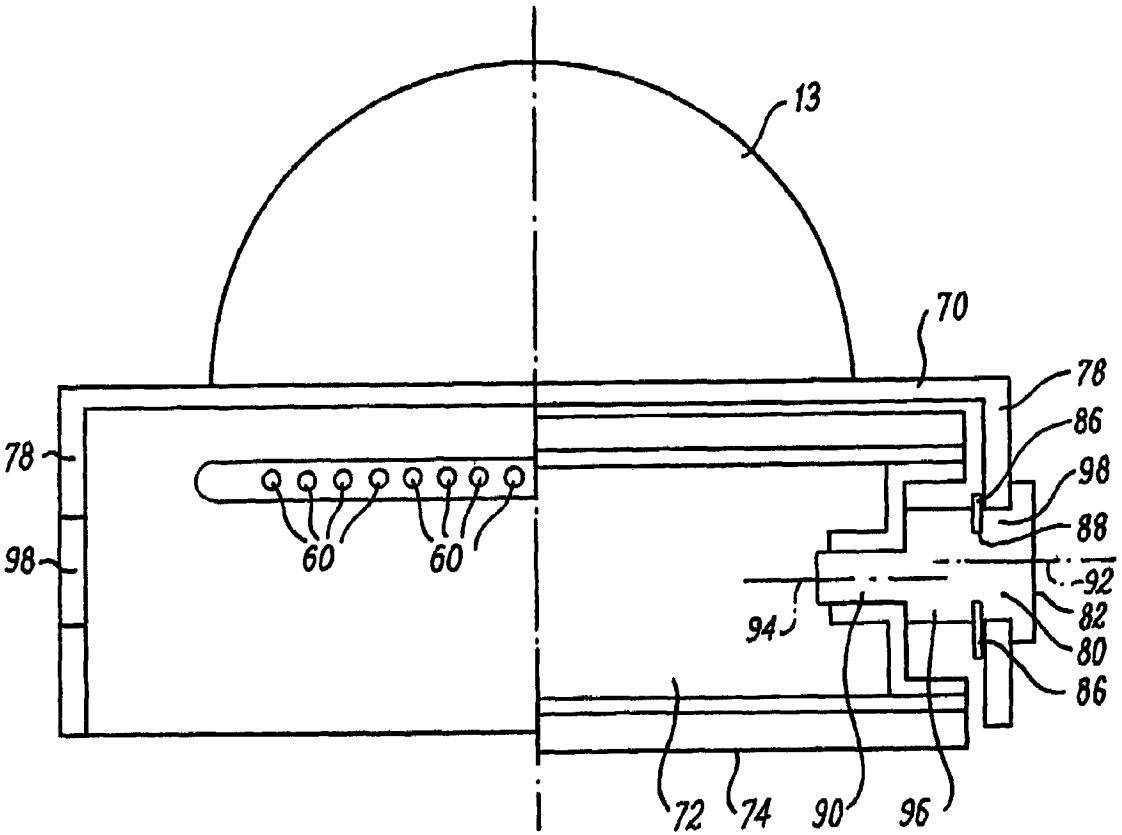
FIG. 3 is a view on a cross-section from the line 111-111 of FIG. 2 showing the head on the right with a roller in position and on the left with the roller removed.

FIGS. 2 and 3 show the roller mounting means. The hood 70 includes spaced opposed side plates 78 between which the roller 72 is mounted between apertures 98 in each plate 78. A stub axle pin 80 extends through each aperture 98 in each plate 78. A stub axle pin 80 extends through each aperture 98 into the roller 72. The pin 80 has a head 82 provided with a slot 84 allowing rotational adjustment with a tool such as a screwdriver. The pin 80 has a body 96 including a circumferential groove 88 engageable with a removable slotted plate 86. The groove 88 is located in use on the inside of the hood side plate 78. The body of the pin 96 defines a longitudinal axis 92. The pin body 96 extends inwardly to an off-set portion 90 having an axis 94. The roller 72 is mounted on the off-set portion 90.

An applicator in accordance with the present invention may be filled with paint by unscrewing head end cap 13 from the cylindrical wall 14. The plunger head 19 is moved away from the applicator head 12 to abut against the handle end cap 11 by the operator gripping the gripping portion 30 and moving the gripping portion 30 away from the head 12. The gripping portion 30 moves until the partially closed end 36 of the gripping member 34 engages the end nut 26 of the rod 20. The operator continues to move the gripping portion 30 away from the head 12 and the plunger 18 is moved until stopped by the end cap 11. The compartment 16 is then filled with paint and the end cap 13 replaced. Conveniently, the tool may be stood upright during filling on the base formed by the planar surface 38.

In use, the applicator and in particular the roller surface 74 is placed against a surface to be painted. The operator, holding the tool by the handle 22, moves the trigger 40 towards the handle 22. The trigger 40 rotates on the pivot 42, moving trigger projection 52 and engaging link plate 48, which rotates into engagement with rod 20. Further movement of the trigger 40 moves the link plate 48 and hence the rod 20 in the direction of the head 12 and against the bias of the spring 46. At the end of its travel, when the trigger 40 is against the handle 22, the operator releases the trigger. The spring 46 biases the link plate and the trigger away from the head 12. This moves the link plate 48 out of engagement with the rod 20 to abut against the passage wall 44. Operation of the trigger 40 is then repeated, advancing the rod 20 and hence the plunger 18 along the paint containing compartment 16 in order to maintain the bias force applied to the paint. As the plunger 18 advances, paint is forcibly driven from the compartment 16 into the passage 60, the recess 62 and onto the roller surface 74. The plurality of passages 60 ensures that the paint is distributed across the width of the roller 72. The recess 62 acts as a plenum chamber to improve and facilitate distribution of the paint to the roller surface 74. The relatively low viscosity of paint and the thixotropic nature of thicker paint means that control of the paint flow is readily achieved by repeated operation of the trigger 40 when necessary to maintain flow.

Further regulation of the paint flow to the roller 72 is achieved by adjusting the gap 66 between the roller surface 74 and the internal surface 76 of the hood, and in particular the edges 64 of the recess 62. The distance of the roller surface 74 from the hood 70 may be adjusted by rotationally adjusting the axle pin 82. The axle pin 82 is rotated by means of a screwdriver inserted in the slots 84, the off-set portion of the pin 90 on which the roller 72 is mounted rotates around the pin axis 92 in order to displace the roller surface 74 relative to the hood internal surface 76.

The features of the gap 66 being minimised at the edges 64 of the recess 62, the radius of curvature of the hood internal surface 76 being greater than the radius of curvature of the roller surface 74, the two surfaces not being concentric and the adjustability of the gap 66 allow the provision of an even and well distributed transfer of paint to the roller surface 74 without paint running along the concave hood internal surface 76 and subsequent messy dripping from the edge of the hood. The roller 72 is adjusted until the roller surface 74 is, in fact, just contacting the recess edges 64 so that a slight frictional resistance to the rotation of the roller 72 can be felt. As the trigger 40 is operated and paint flows, the contact between the recess edges 64 and the roller surface 74 prevents leakage of the paint but allows a controlled amount of paint onto the roller surface 74. The effect of the widening gap 66, the surface tension of the paint, and the moving surface of the roller 74 has the result that substantially all of the paint is carried from the recess edge 64 by the surface of the roller 74, rather than dribbling round the internal surface of the hood 76. Control of paint pressure is possible by the manual operation of the paint biasing means, and the specific control of the distance between the roller surface 74 and the recess edges 64 is possible due to the adjustable roller mountings. Thus, varying paint loadings suitable for different surfaces and the use of paints of different viscosity are possible.

The relatively low viscosity of paint in comparison to, for instance, the mastic in a mastic gun means that the paint flows readily in response to movement of the trigger, and flow substantially ceases when movement of the trigger ceases. Once movement of the trigger has stopped, flow out of the passages 60 stops due to the relatively small diameter of the passages 60, the surface tension of the paint, and the effect of atmospheric pressure, preventing leakage of the paint.

During painting operations, the plunger 18 will move along the paint containing compartment 16 until it reaches the head end cap 13, at which point the applicator can be refilled with paint in a similar manner to that described previously.

On completion of the painting operation, the head end cap 13 is removed from the wall 14 and any remaining paint in the compartment 16 emptied back into the original paint container. The trigger 40 is then operated to move the plunger 18 along the compartment 16. The close fit of the plunger head 19 to the wall 14 effectively wipes the internal wall surfaces substantially clean of any paint and when the plunger head 19 appears at the open end of compartment 16, the plunger head surface itself may be cleaned. The plunger head 19 may then be withdrawn as described above and the compartment 16 filled with a quantity of water or a suitable paint cleaning solvent. The head end cap 13 is then replaced and the trigger 40 operated to flush the solvent through the passages 60 and recess 62, cleaning the passages and recess. Thus, the tool can be rapidly cleaned without excessive waste of surplus paint.

The roller 72 is removable from the hood side plates 78 by simply moving the slotted plates 86 out of engagement with the grooves 88 of the pins 80. The pins 80 may then be withdrawn from the side plate 78 allowing the roller 72 to be removed from the hood 70.

Figure 4:
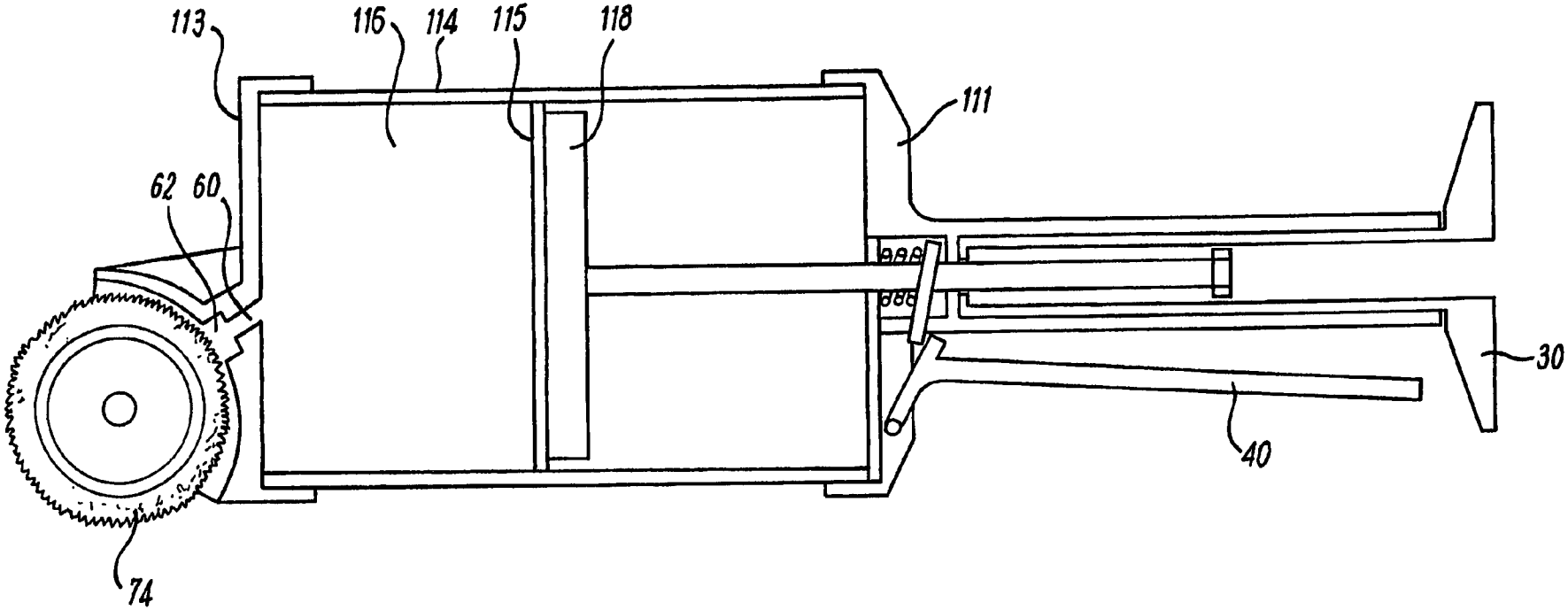
FIG. 4 is a similar view to FIG. 1 of an alternative embodiment of an applicator according to the present invention.

FIG. 4 shows another embodiment of an applicator for applying paint to a surface, in which a pre-filled paint cartridge is utilised. Since the majority of features are the same as for the embodiment shown in FIG. 1, only those features which are different will be enumerated and described. The cartridge includes a cylindrical wall 114 having at one end a movable end wall 115 and at the other end a removable end cap (not shown) threadably engaged with the wall 114. In use, the removable end cap is removed and a head end cap 113 similar to the head end cap previously described is fitted to the cartridge wall 114. The one end of the cartridge is fitted into the handle end cap 111, the one end and the handle end cap being provided with threaded engagement means. The plunger 118 is movable within the cartridge to engage the movable end wall 115. Operation is similar to that described previously. As the trigger 40 is operated, the plunger 118 moves the end wall 115 to force paint from the cartridge compartment 116 through the passage 60 and recess 62 to the roller surface 74. When the end wall 115 has been moved along the compartment 116 to abut the end cap 113, the end cap 113 is removed, the cartridge is removed from the handle end cap III and the cartridge is discarded. The plunger 118 is then withdrawn by means of the gripping portion 30 and a new cartridge fitted to the tool. The use of pre-filled cartridges removes the need for the refilling operation and reduces the amount of cleaning required, both of which can be messy, inconvenient and time consuming operations.

Figure 6:
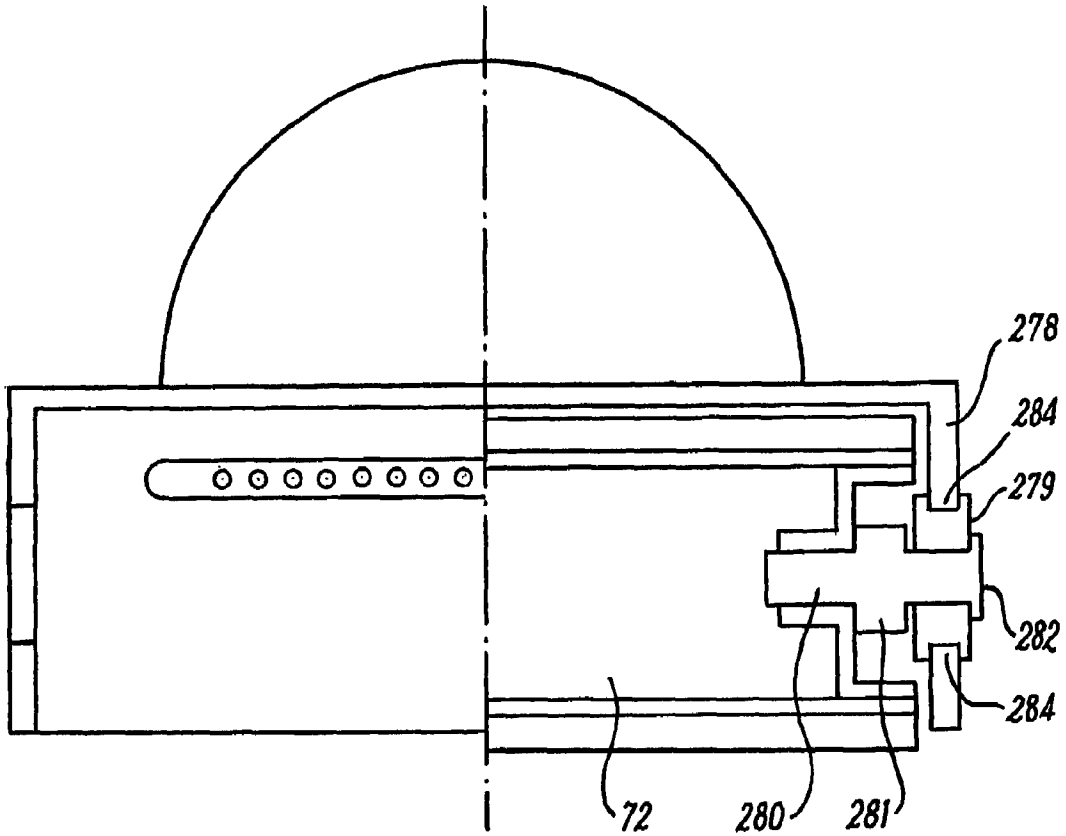
FIG. 6 is a view on a cross-section from the line VI-VI of FIG. 5 showing the head on the right with a roller in position and on the left with the roller removed.
Figure 5:
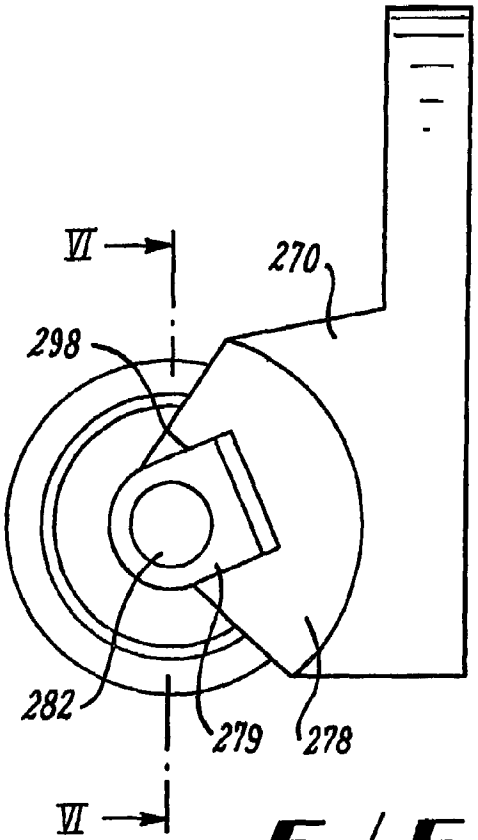
FIG. 5 is a side view of the applicator depicted in FIG. 4.

FIGS. 5 and 6 show an alternative adjustable roller mounting means. In this embodiment, the hood side plates 278 each include a slot 298 in which a mounting plate 279 is slidably movable. The mounting plate 279 defines a mounting plate aperture 281 through which a stud axle pin 280 passes, and on which roller 72 is mounted. Engagement means are provided between mounting plate 279 and the sides of the slot 298, the engagement means arranged so that the mounting plate 279 is a friction fit within the slot 298. The slot 298 is directed so that as the mounting plate 279 is moved, the roller 72 is moved towards or away from the recess edges 64, thus adjusting the gap 66. The engagement means includes engagement slots 284 in the sides of the mounting plate 279 abutting the sides of the slot 298, the said slot sides being receivable in the engagement slots 284. The stub axle pin 280 includes a thickened portion 281 which abuts an end of the roller 72 preventing longitudinal movement of the roller 72 along the pin axis. The thicker portion 281 also abuts the mounting plate 279 preventing disengagement of the pin 280 from the mounting plate 279.

In use, adjustment of the gap between the roller and the internal surface of the hood is accomplished simply by moving the mounting plates 279 within the hood side plates and slots 298. Likewise, the roller 72 is simply removed from the hood 270 by withdrawing the mounting plates 279 from the side plate slots 298.

FIG. 8 shows an alternative head end cap 313 which may be used in place of the head end cap 13 previously described. The head end cap 313 includes a threaded spigot 314 having a passage 316 therethrough.

FIGS. 7*a* and 7*b* show alternative paint distribution means, each having a threaded socket 318 engageable with the head end cap threaded spigot 314 and a passage 320 communicatable with passage 316 of the end cap 313. FIG. 7*a* shows a paint distribution means 321 including a sponge pad 322 having a piled surface 324. In FIG. 7*b*, the paint distribution means 325 includes a roller 326 having a piled roller surface 328. The roller of FIG. 7*b* is of smaller diameter and length in comparison to the roller shown in FIGS. 1-5. In both cases, paint regulation can again be achieved through gap control, thixotropic effects etc.

In use the paint containing compartment 16 is filled as previously described and the head end cap 313 fitted to the wall 14 of the tool. The paint distribution means 321 or 325 of either FIG. 7*a* or FIG. 7*b* may then be fitted by threadably engaging socket 318 to spigot 314. As the trigger 40 is operated, paint is forced from the compartment 16 through the passages 316, 320 to the respective surface 324 or 328. Control of the flow is accomplished by means of the trigger operation.

FIG. 9 shows a connection 330 suitable for interposing between the head end cap 313 and the paint distribution means of FIG. 7*a* or 7*b*. Connection 330 includes a first connection member 332 having a threaded socket 342 engageable with the threaded spigot 314 of the end cap 313. A second connection member 334 is pivotally mounted to the first connection member 332 and includes a threaded socket 344 substantially the same as the threaded socket 314 of the end cap 313. First and second connection members 332 and 334 define a conduit or passage 336 through which a flexible pipe 338 passes. In use, the socket 342 of the first connection member 332 is fitted to the spigot 314 of the end cap 313, and the socket 318 of one of the paint distribution means 321 or 325 is fitted to the spigot 344 of the second connection member 334. The passage 316 of the head end cap 313 communicates with a pipe passage 340, which in turn communicates with the passage 320 of the paint distribution means. The pivoted connection means allows the paint distribution means to be used at an angle to the axis of the body of the tool which is particularly advantageous when painting in confined spaces or near to corners.

FIG. 10 shows an alternative trigger arrangement. The trigger 440 is formed integrally with the end cap 411 of a flexible and resilient material. Thus, the trigger 440 is resiliently movable relative to the end cap 411. The trigger 440 extends to form a pair of parallel, spaced projections 449, between which a plunger rod 420 passes. The projections 449 engage the link plate 448. Due to the resilient mounting of the trigger 440, the projections 449 bias the link plate 448 out of engagement with the plunger rod 420 and against passage wall 444. A further trigger projection 452 engages an end of the link plate 448. In use, the trigger 440 is moved towards the handle 422, simultaneously moving projections 449 away from link plate 448 and bringing trigger projection 452 into engagement with the end of link plate 448. Thus, the link plate 448 rotates into engagement with plunger rod 420. Further movement of the trigger 440 moves the link plate 448 and rod 420 in the direction of the head (not shown). The integral trigger and end cap arrangement of resilient flexible material reduces the number of components required, reducing complexity and cost.

FIGS. 11 and 12 show pouring apparatus for a paint can, the apparatus including a pouring member 510 having a concave pouring surface 512 and extending at one end to an apex 514. At the other end, the pouring member includes engaging means engageable with a portion of the rim of a can 516. The engaging means, as shown in FIG. 12, includes a lip 518 extending laterally from the end of the pouring member 510. A projection 520 extends at first obliquely and then downwardly in use from the pouring member. At the end of the projections 520, a portion extends downwardly and parallel with the pouring member 512. The projection 520 and the lip 518 together form a recess 528 in which the rim of the paint can 516 is receivable. In use, the paint can 516 is opened and the pouring member 512 fitted on the paint can 516. A portion of the rim 522 of the paint can 516 is thus received in the recess 528. The paint can may then be tilted to dispense paint over the pouring surface 512 and for example into the paint containing compartment 16 of the applicator as described previously. Any drips falling outwardly from the pouring member 512 will not foul the rim of the paint can since this is enclosed by the projection 520. When the paint can is set upright after pouring, any paint left on the pouring surface 512 will run back down the pouring surface onto the surface 526 of the paint in the can at a point away from the sides of the can. Likewise, brushes may be wiped on the pouring surface 512 of the pouring member. When painting has finished, the pouring apparatus may be disengaged from the rim of a can 516 and the lid of the can replaced. The pouring apparatus ensures a clean rim to receive the lid and overcomes the problem of dry, encrusted paint making lid removal difficult on subsequent occasions.

Various modifications may be made without departing from the scope of the invention. The embodiments of FIGS. 1 and 4 essentially show a tool suitable for single handed use. However, an extension could be provided in or for the tool which then may be suitable for use with two hands. Such an extension may be convenient for decorating surfaces otherwise out of reach, for instance the upper surfaces of walls or ceilings. Other paint distribution means may be used, particularly, for instance a brush or a combination of a brush and a roller, and other methods of adjustably mounting the roller may be used. Alternative paint biasing means may be used. Alternative control means to those described may be used. In particular, the plunger may be other than hand powered, such as compressed air or gas. The trigger may be replaced by a release button or switch. Alternative types of pre-filled cartridge may be used, and in particular pre-filled sachets or bags placed in the paint containing compartment, punctured and the end cap replaced may be used. The pre-filled cartridge may be held in a different way to that described. For instance, the cartridge may be loosely held in position by a housing or frame.

The walls and in particular the paint containing compartment may be made of translucent or transparent material or may incorporate a window of translucent or transparent material, providing a visual indicator of the amount of paint left in the paint containing compartment.

The flow regulation means may include a pair of elongate projections located at or adjacent to the edges of the recess and aligned parallel with the axis of the roller, and the projections may be rounded in form. The roller surface may be textured or include patterns. One or some of the passages 60 may be blocked to control or vary the distribution of paint to the roller to produce patterns of different effects on the surface to be painted. The passages 60 may be flared.

The gripping member 34 may be biased to a retracted position within the handle passage 24.

FIGS. 13 and 14 depict a refinement to an applicator head 600 in which a V shaped slot 601 is provided through which paint is presented to a roller 602. The applicator arrangement operates in a similar manner to that described previously whereby paint is presented through the slot 601 to become incident upon the roller 602 and therefore allow paint distribution by a rolling action. As previously typically shields 603, 604 are provided in order to limit speckle/spray distribution of paint as the roller 602 rotates. However, it will be appreciated that as the present paint applicator arrangement specifically distributes paint through the slot 601 to the roller 602, the foam or bristle depth of that roller 602 is generally less than previously required. It will be understood that previous roller arrangements required loading with paint such that foam depth or bristle length is necessary in order to allow sufficient paint to be loaded to the roller for operation over a reasonable period of time. The present paint applicator arrangement is specifically and continuously provided with paint as described previously and therefore such foam or bristle depth is not required. Nevertheless, there is a potential for over delivery of paint to the roller 602 particularly transiently during each grip pump action. It will be understood that each grip pump action forces a squirt of paint through the slot 601. This paint is then distributed upon the roller for application as described previously. In such circumstances, there is a transient over presentation of paint to the roller 602 which may be relatively significant if the grip pump length and therefore volume of paint delivered is relatively large. In such circumstances, the present invention provides paint traps 605, 606 which act to smooth the transient overloading of the roller 602 by affectively smearing that overloading over a wider area of the roller 602. Clearly, over time if there is excessive grip pumping, repeated pumping action when not required, then these traps may become filled with paint but generally, through appropriate sizing and positioning, these traps 605, 606 will be of sufficient dimensions to accommodate all but deliberate overloading of paint to the roller 602.

Generally, the traps 605, 606 will be wedge shaped for appropriate collection of paint for smearing on the roller 602. It will be understood that the traps 605, 606 are designed merely to act as transient reservoirs for excess paint pumped through the slot 601 in order that the roller 602 as a result of its reduced inherent capacity due to thinner foam or bristle depth it does not become saturated with paint whereby the roller 602 slides rather than rolls for paint distribution over a surface. It will be understood that the traps 605, 606 will facilitate paint distribution but nevertheless rotation of the roller 602 will generally equalise paint distribution across the width of the roller 602 as it is rotated on a surface to be painted.

The trap 605, 606 will be incorporated into the depth of the applicator head 607 by moulding or other appropriate shaping.

FIGS. 15 and 16 illustrate further refinements of the present invention whereby a more limited grip pump displacement length is achieved to reduce the volume of paint delivered through a slot to a roller in accordance of the present invention and whereby an extension handle can be provided to allow operation of an applicator in accordance with the present invention at displaced or elevated positions.

Generally, the applicator 700 operates in a fashion similar to that described previously in that a paint canister 701 is acted upon by a pump grip 702 such that displacement in the direction of arrow head A causes movement of a piston or plunger 703 towards an applicator head 704 whereby paint held within the canister 701 is forced through a slot 705 for distribution by a roller 706 incorporated in that head 704. The roller 706 depicted in FIG. 15 also includes a cam adjustment arrangement described later with regard to FIG. 20.

It will be appreciated that the greater the displacement of the plunger 703 then the greater the volume of paint forced through slot 705 to the roller 706. In such circumstances, it will be understood that the volume of paint forced through the slot 705 is the product of displacement distance multiplied by piston 703 cross-sectional area. Generally, paint canisters 701 are relatively broad in terms of cross-sectional area for storage convenience. Thus, it is desirable to limit the displacement distance due to each piston 702 action.

In the embodiment depicted in FIGS. 15 and 16 there is limited displacement for each pump action. This is achieved by provision of a lift spring attachment 707 to the head and a relatively limited travel distance represented by arc 708. Thus, each piston 703 action through that arc 708 only creates a limited nudge movement of the retainer 709 for displacement of the piston 703. Limited nudge displacement causes less paint volume to be forced through the slot 705 to roller 706 for better control.

Generally, the displacement will be limited as depicted in FIGS. 15 and 16 but this arc 708 may be adjusted through provision of an adjustable stop element 710 secure to the stem 711 to limit the displacement arc 708 of the grip 702 until engagement and therefore stop against the element 710.

Generally, as depicted a grip pump assembly is attached to a paint canister through a screw thread 712. In accordance with a further refinement of the present invention, this grip pump assembly may be removed from the canister in order to allow an extension handle 801 to be secured to that canister at one end and the grip pump assembly at the other. Thus, the applicator arrangement may then be used at displaced or elevated positions from the user whilst that user can still utilise the grip pump action in order to present paint to a roller for appropriate operation.

Possibly, a problem with a grip pump assembly as described previously is that when vertically inclined the ink plate may drop making nudge displacement difficult. Thus, a slight resistance through a plastic insert between the ink plate and rod may be provided to stop such dropping.

The retainer 709 includes a rest 720 against which a user's hand can rest in use to provide support and help with control of the applicator. This rest 720 also acts as a grip handle for movement of the retainer for piston release movement and adjustment of the plunger position.

As indicated above FIG. 17 depicts a typical extension handle 801 utilised in association with an applicator in accordance with the present invention. Thus, the handle 801 comprises a male screw thread 802 to which the handle 801 is secured through an end member for a paint canister (not shown). A female screw thread 803 is provided to which the grip pump assembly (not shown) is secured. As indicated above, generally this grip pump assembly will normally be that associated more directly with the paint canister. An actuator rod 804 is provided within the handle 801. This actuator rod 804 includes means as illustrated in the form of threads 805, 806 to which the canister end and the grip pump assembly respectively are secured. It will be appreciated that the length of the handle 801 will be determined by operational requirements to provide for displaced and/or elevated operation of a paint applicator arrangement in accordance with the present invention. In short, the use of the actuator rod 804 allows through displacement of that rod in the direction of arrow heads B for the necessary pump action for displacement of a piston or plunger relative to the paint canister as described previously.

The extension handle 801 is easily secured to the canister and to the grip pump assembly through screw heads 802, 803 and screw threads 805, 806 of the actuator rod 804. The actuator rod 804 effectively becomes an extension of the piston rod used for displacement of the piston within or relative to the paint canister as described previously. Clearly, the weight of the extension handle 801 is important such that generally this handle 801 is made from light weight materials such as aluminium or possibly plastic materials. Nevertheless, the actuator rod 804 must be robust and relatively rigid in order to translate the displacements in the grip pump assembly to provide for reciprocal displacement of the piston for paint pumping action. In such circumstances, if the actuator rod 804 were flexible or elastic, the relatively small displacements necessitated by appropriate paint pumping action may not be adequately translated through the extension handle 801. Similarly, the screw threads 805, 806 should also faithfully translate such displacements through the actuator rod 804 for appropriate movement of the piston rod and therefore piston within the paint canister for paint distribution on to a roller. Although screw threads are depicted, it will be appreciated that other techniques may be utilised including bayonet fittings or radial compression fittings such as jubilee clips or possibly simply interference connections provided.

The connections between the extensions handle 801 and canister may be such as to allow a 180° rotation between an orientation for walls and an orientation for ceilings in terms of roller head angle.

Generally, paint canisters 701 as described above will be of a round cross-section. It will be understood that such a cross-section is not ideal with regard to presenting paint through a slot located centrally within the canister 701 particularly when that canister 701 is nearly empty. In such circumstances, in accordance with the present invention, canisters may be provided which have an elongate cross-section reciprocal with the slot 701. Thus, canisters may be oval or rectangular in cross-section with the slot 705 being substantially aligned with the major cross-sectional width of the canister. Furthermore, the canister may be shaped with wedge or curved sections towards the slot in order to guide paint towards that slot. The top of the piston may be similarly shaped to mate with the sloped or wedged surfaces of the canister adjacent to the slot 705 in order to further provide guidance of the piston relative to the slot. A top portion of the piston may also have a compliant nature to facilitate mating with the canister in a curved or wedged surface near full extension towards the slot 705.

A particular problem with previous paint distribution systems which generally present paint from a central slot has been appropriate distribution of that paint across the full or sufficient width of the roller to provide paint distribution for effective paint application. It will be understood a central slot without the provision of a trough or otherwise will not appropriately present paint and that inclusion of a trough adds to potential paint leakage. In such circumstances, previous paint distribution to rollers has generally necessitated provision of a colander or perforated roller such that paint is presented centrally to a hollow core of the roller and therefore forced through the perforations in the colander or perforated roller onto the roller surface for appropriate application. Such arrangements are difficult to accommodate and require a rotary seal to allow paint to enter the hollow roller and it will be understood that there is significant paint invested within the hollow cavity of the roller which may be lost during each "clean down".

In accordance with the present invention there is also provided a delta paint distribution insert as depicted in FIG. 18. This insert 901 comprises a network of trench grooves 902 which extend from an inlet side 903 to an outlet side 904. The network 902 is configured such that the flow resistance from the inlet side 903 to the outlet 904 is smoothed across the width of the outlet side 904. Thus the grooves in the network 902 divide at various points such that the cross-section of the grooves at different positions varies by constriction and also division. Thus, groove 902*a* has a direct path to the edge portions of the outlet side 904 whilst arterial grooves 902*b* extend to grooves 902*c* which extend to intermediate parts of the outlet side 904 whilst secondary arterial grooves 902*d* connect to grooves 902*e* which present to central portions of the outlet side 904. In such circumstances, there is generally equalised flow through the outlets of the grooves 902*a*, 902*c*, 902*e* at the outlet side 904 despite single point central pressurised paint flow at the inlet side 903.

FIG. 18 shows in FIG. 18*a* a plan view of a delta insert 901 in accordance with the present invention whilst FIG. 18*b* depicts the outlet side 904. As can be seen generally the insert 901 comprises a relief pattern of grooves 902 in a plate. Thus, the insert 901 will be located within a distribution wedge of hollow nature with a narrow part of that wedge secured to the paint supply conduit and the longitude nor slot part associated with a paint roller in accordance with an applicator. With the paint presented to the roller in a broad front rather than biased towards direct central paint flow towards the roller, it will be understood that paint spread due to rotation of the roller will more rapidly occur for efficient paint distribution upon a surface.

FIG. 19 illustrates incorporation of the insert 901 in an applicator. Thus, as can be seen paint is presented through a conduit at an inlet 910 such that it flows in the direction of arrow head C for distribution through grooves 901. The paint is distributed upon a roller 911 which upon rotation applies that paint to a surface (not shown). The roller 911 is secured within an applicator head 912 which may operate in accordance with previous description. Thus, by use of the insert 901 an even distribution of paint to the roller 911 is achieved without the necessity of providing a deep equalising trough within the head 912 which may create leakage problems through foam or bristles of the roller 911.

Paint leakage is a significant problem with respect to rollers utilising pump action. Clearly, pump action with regard to the paint forces paint flow but by implication there has to be at least controlled leakage of that paint flow for distribution upon a roller. In accordance with the present invention, a roller is provided with an asymmetric or eccentric roller position whereby there is appropriate presentation of paint to the roller. In short, it's desirable that the roller is effectively in close contact with the applicator head on the side upstream of roller rotation whilst there is a slight gap for paint flow on to the roller at the downstream side. Unfortunately, paints have different flow and viscosity characteristics and these may vary themselves through aging and local environmental conditions e.g. temperature. Thus, in accordance with the present invention, a cam arrangement is provided whereby the roller is secured asymmetrically and this cam arrangement can be adjusted for different paint types and conditions.

FIG. 20 illustrates an applicator head 1001 incorporating a roller 1002 secured through a rotation pin 1003 which extends through a slot 1004 in the head 1001. The roller 1002 rotates about the pin 1003 such that a surface 1005 is brought adjacent to a paint outlet 1006 of the head 1001. As described previously, the association between the surface 1005 and the outlet 1006 is idealised for paint distribution with limited leakage. To achieve such best association between the outlet 1006 and the surface 1005, the slot 1004 and pin 1003 are slightly off centre such that rotation within the head 1001 is eccentric. Adjustment of such eccentric rotation of the roller 1002 is adjusted by forming the pin 1003 in a fashion whereby it can be adjusted within the slot 1004 to differing positions depending upon requirements. Thus, the pin 1003 may take the form of a screw head which may be brought into compressive engagement with the slot 1004 at the appropriate position necessary for appropriate rotation of the roller 1002 whereby the gaps between the surface 1005 either side of the outlet 1006 are such that best performance is provided. As indicated previously generally this will be with the gap 1007 on the side of first association in the direction of rotation of the roller 1002 (arrow heads D) minimised to prevent leakage whilst there is a greater gap 1008 on the down stream side of roller 1002 rotation (arrow heads D) so that paint is distributed on the surface 1005.

In order to secure location generally, the screw head 1003 will be screwed to provide for an interference engagement with the screw head 1004. There may be some form of toothed or other grip association to further retain such location.

The roller is allowed to be altered with horizontal movement in and out relative to the applicator head. As indicated, the cam is secured by a screw head pin. If that screw head has a slot head, that slot may be aligned with markings consistent with different roller positions for different roller and/or paint types.

In accordance with the present invention, there is provided an applicator tool for applying paint to a surface having a number of advantageous features over conventional apparatus. The feature of the gripping means being in line with the axis of the body means that the applicator can be handled in the same way as a conventional painting tool such as a roller. The integral paint container means that the painting operation can be continuous without requiring an operator to stop and reload a brush or a roller. The paint biasing means provides a controllable flow of paint to the paint distribution means and may be controlled by the operator without lifting the paint distribution means from the surface being painted. The applicator may be easily adjusted to cater for paint of different viscosity and for use on different surfaces, and a variety of different paint distribution means may be used. The present applicator tool is an integral unit capable of independent use and operation. Furthermore, it will be appreciated that paint and in particular full paint canisters can be heavy. Thus, in order to improve balance and convenience, it might be advisable where extension handles or long handle paint applicators are used to provide the paint canister or can at the bottom or grip end of the handle away from the roller head.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An applicator for applying paint to a surface, the applicator including a body for paint, paint distribution means to distribute paint in use onto a surface by contact with that surface, the paint distribution means having a head comprising a roller and hood, the body including paint biasing means to bias, in use, the paint toward the distribution means, and configured to act in association with operating control means for control of the bias means and so the flow of paint to the paint distribution means, the applicator characterized in that the paint biasing means acts by applying incremental axial displacement of the paint; the head includes mounting means for rotably mounting in the hood the roller with a roller surface which in use contacts the surface to be painted, the head includes flow regulation means to regulate the flow of paint to the roller surface in association with the biasing means and the flow regulation means includes a gap defined between a distribution means surface of the roller and the hood, achieved by positioning of the mounting means within the head.

2. An applicator as claimed in claim 1, wherein the paint distribution means is releasably engageable with the body and forms a separable applicator head.

3. An applicator as claimed in claim 2, wherein the applicator includes connection means interposed between the applicator head and the body.

4. An applicator as claimed in claim 3, wherein the connection means is articulated to allow the angle of the paint distribution means to be varied relative to the longitudinal axis of the body.

5. An applicator as claimed in claim 1, wherein the hood partially encloses the roller.

6. An applicator as claimed in claim 1, wherein the head includes at least one passage defined in the hood.

7. An applicator as claimed in claim 6, wherein where there is more than one passage the passages are arranged in a row running parallel with the axis of the distribution means surface.

8. An applicator as claimed in claim 7, wherein the row of passages extends substantially the width of the surface.

9. An applicator as claimed in claim 7, wherein the row is shorter in length than the width of the surface, and each end of the row is not less than 25 mm from the corresponding end of the surface.

10. An applicator as claimed in claim 9, wherein the gap is at a minimum at or adjacent to the or each passage.

11. An applicator as claimed in claim 10, wherein the hood includes a concave internal hood surface.

12. An applicator as claimed in claim 11, wherein the hood has a different radius to the roller surface.

13. An applicator as claimed in claim 12, wherein the hood is of larger radius than the surface.

14. An applicator as claimed in claim 13, wherein the roller surface and the hood surface are not concentric.

15. An applicator as claimed in claim 14, wherein the roller surface and hood surface diverge away from each other about the passages.

16. An applicator as claimed in claim 15, wherein the head includes a recess defined in the hood, and the or each passage leads to the recess.

17. An applicator as claimed in claim 16, wherein the recess forms a plenum chamber.

18. An applicator as claimed in claim 17, wherein the recess extends substantially the width of the distribution means surface.

19. An applicator as claimed in claim 18, wherein each end of the recess is not less than 18 mm from the corresponding end of the distribution means surface.

20. An applicator as claimed in claim 19, wherein edges are defined where the recess meets the internal hood surface, and the gap is at a minimum at the edges.

21. An applicator as claimed in claim 20, wherein the distribution means surface contacts the edges.

22. An applicator as claimed in claim 21, wherein elongate projections are provided along the edges parallel to the roll axis of the roller, and the projections are rounded in form.

23. An applicator as claimed in claim 1, wherein the mounting means for the roller are adjustable, so that a minimum gap is adjustable.

24. An applicator as claimed in claim 1, wherein the mounting means allows the roller to be removed from the head.

25. An applicator as claimed in claim 1, wherein a paint trap is provided adjacent to the roller.

26. An applicator as claimed in claim 1, wherein there is a stop member to limit the bias means for control of the flow of paint.

27. An applicator as claimed in claim 1, wherein the bias means is associated with an extension handle to allow displaced or elevated operation of the applicator.

28. An applicator as claimed in claim 1, wherein the distribution means surface includes textures or patterns to facilitate paint distribution on the surface to be painted.

29. An applicator as claimed in claim 1, and comprising a paint container, and wherein the body includes holding means for the paint container.

30. An applicator as claimed in claim 29, wherein the paint container is formed of translucent material, to provide a visual indication of the amount of paint in the container.

31. An applicator as claimed in claim 29, wherein the paint container is removable.

32. An applicator as claimed in claim 29, wherein the paint container is elongate with an oval or rectangular cross-section with the major axis substantially aligned with a slot of the applicator.

33. An applicator as claimed in claim 1, wherein the body includes refilling means.

34. An applicator as claimed in claim 33, wherein the refilling means comprises a threaded end cap.

35. An applicator as claimed in claim 1, wherein the paint biasing means includes a plunger, which is movable to act on the paint in the body or the paint container such that as the plunger advances, the bias on the paint forces flow to the paint distribution means.

36. An applicator as claimed in claim 35, wherein the plunger includes rod means, which extends away substantially along the longitudinal axis of the body from a plunger head acting upon the paint.

37. An applicator as claimed in claim 36, wherein the body includes gripping means having a handle in the form of a tube having a passage therethrough.

38. An applicator as claimed in claim 37, wherein the rod means extends into and along the handle.

39. An applicator as claimed in claim 38, wherein the rod means extends beyond the handle and includes a gripping portion at its distal end by which the plunger is moved.

40. An applicator as claimed in claim 39, wherein the gripping portion includes a lateral extension, extending laterally beyond the handle.

41. An applicator as claimed in claim 40, wherein the lateral extension forms a base on which the tool is supported, and includes a planar surface perpendicular to the longitudinal axis of the body.

42. An applicator as claimed in claim 41, wherein the rod means comprises a rod extending from the plunger head and a gripping member telescopically mounted within the handle and slidably engaged with the rod.

43. An applicator as claimed in claim 42, wherein a gripping portion is mounted on the gripping member.

44. An applicator as claimed in claim 43, wherein the gripping member is biased to a retracted position.

45. An applicator as claimed in claim 37, wherein the control means includes a trigger mounted on or adjacent to the handle.

46. An applicator as claimed in claim 45, wherein the handle includes a linkage operable by the trigger to advance the plunger.

47. An applicator as claimed in claim 46, wherein the linkage comprises a link plate having an oversized aperture through which the rod passes.

48. An applicator as claimed in claim 47, wherein the link plate is biased towards the trigger and, in a relaxed condition, out of engagement with the plunger, so that as the trigger is operated the link plate is brought into engagement with the plunger, further operation of the trigger moving the link plate towards the paint in the body or container and causing the plunger to advance to bias the paint towards the distribution means.

49. An applicator for applying paint to a surface wherein that paint is distributed by a roller and the roller is secured through a cam whereby the roller rotates with a rollover rotation past a paint outlet formed in a head characterized in that the rollover rotation is eccentric with differing gap widths between a first gap width between a roller surface and the outlet of the head on one side of the head outlet and a separate gap width between the roller surface and the outlet of the head on another opposed side of the outlet in the roller rotation direction.

50. An applicator as claimed in claim 49, wherein an aperture is provided within which a pin is secured to provide for eccentric rotation as well as varying the gap width between the roller and the respective one side and the other opposed side of the outlet.

* * * * *